United States Patent [19]

Bailey

[11] 4,146,178

[45] Mar. 27, 1979

[54] UNIT FUEL INJECTOR

[75] Inventor: John M. Bailey, Dunlap, Ill.

[73] Assignee: Caterpillar Tractor Co., Peoria, Ill.

[21] Appl. No.: 798,056

[22] Filed: May 18, 1977

[51] Int. Cl.[2] ..... F02M 47/02

[52] U.S. Cl. ..... 239/90; 123/139 AB; 123/139 AK; 123/139 AR; 239/95

[58] Field of Search ..... 239/88, 90, 91, 95, 239/127; 123/139 AB, 139 AD, 139 AE, 139 AK, 139 AR

[56] References Cited

U.S. PATENT DOCUMENTS

| | | | |
|---|---|---|---|
| 2,144,862 | 1/1939 | Truxell, Jr. | 239/88 |
| 2,317,618 | 4/1943 | King | 239/88 |
| 3,667,437 | 6/1972 | Dreisin | 123/139 AE |

FOREIGN PATENT DOCUMENTS

| | | | |
|---|---|---|---|
| 483468 | 7/1953 | Italy | 239/91 |

*Primary Examiner*—Robert B. Reeves
*Assistant Examiner*—Michael J. Forman
*Attorney, Agent, or Firm*—Phillips, Moore, Weissenberger, Lempio & Majestic

[57] ABSTRACT

The unit fuel injector disclosed is directly mountable on cylinder heads in an internal combustion compression ignited engine. The device includes a housing with a spring-biased cam operated reciprocating piston mounted therein. The ported piston has a constant length stroke in the two embodiments disclosed. The quantity of fuel injected on each constant length stroke is determined by a movable ported sleeve member in which the piston reciprocates. Fuel is supplied to the unit fuel injector through appropriate porting in the cylinder head in a conventional manner.

10 Claims, 2 Drawing Figures

UNIT FUEL INJECTOR

BACKGROUND OF THE INVENTION

This invention relates to injection devices for internal combustion engines. In particular it relates to a unit injector which would be associated with an individual cylinder in a compression ignition type internal combustion engine.

Conventionally, compression ignition engines of a diesel type operate with a fuel pump adapted to communicate fuel to each individual cylinder in response to a timing apparatus so that efficient engine operation occurs. Although fuel pumps for such diesel engines are well advanced, they have certain disadvantages. Because fuel lines are required to conduct fuel from the pump to the cylinders and since this requires a given amount of time, injector timing is delayed as engine speed increases. This requires a variable timing arrangement in the fuel pump drive to advance the timing as engine speed increases. Furthermore, since the high pressure lines contain a relative high volume of fuel, the pump discharge is sensitive to changes in fuel properties and control of injection is less positive than desired.

Accordingly, it is appropriate to pressurize the fuel at the cylinder for injection therein in response to a pumping stroke. Such a procedure overcomes the problems of variations in the pressure, temperature, and other handicaps associated with a central fuel pump arrangement. The unit injector includes a high pressure fuel pump and an injector mechanism in a single housing which communicates with the combustion chamber of an engine through a conventional nozzle. Fuel is provided the unit injector through a low pressure fluid transfer mechanism while timed pumping is provided at the individual injector pump. From the manufacturing standpoint it is advantageous to design a relatively symmetrical unit injector to avoid machining non-symmetric scrolls used in most injectors. Furthermore, such symmetry avoids accurate orientation upon installation.

The discharge rate, or fuel injection quantity, of most presently available unit injectors is usually controlled by a scroll-rack similar to that generally employed by conventional fuel pumps. Use of the rack complicates the housing and requires that a unit injector be precisely located in the cylinder head.

SUMMARY AND OBJECTS OF THIS INVENTION

The present invention is directed to overcoming one or more of the problems as set forth above.

Broadly stated, the invention is a unit fuel injector comprised of an elongated body having an axial bore therethrough with a first radial passage communicating fuel to the bore and a second radial passage for communicating fuel from the bore. The second radial passage is axially displaced from the first radial passage. A pressure actuated nozzle is affixed to one end of the body, while a plunger is resiliently biased to a first position in the bore to form a first cavity with the nozzle and the bore. The plunger is reciprocally movable in a first direction for blocking the first passage and increasing pressure of fluid in the cavity sufficiently to actuate the pressure actuated nozzle so that fluid is communicated outwardly of the cavity. A sleeve is slidably disposed about the plunger and within the body and is axially positionable along the plunger for cooperation therewith in causing the increase in pressure in the cavity and further for venting the cavity to the second radial passage at a predetermined position of the plunger relative to the sleeve.

DETAILED DESCRIPTION OF THE PREFERRED EMBODIMENT

Figure 1:
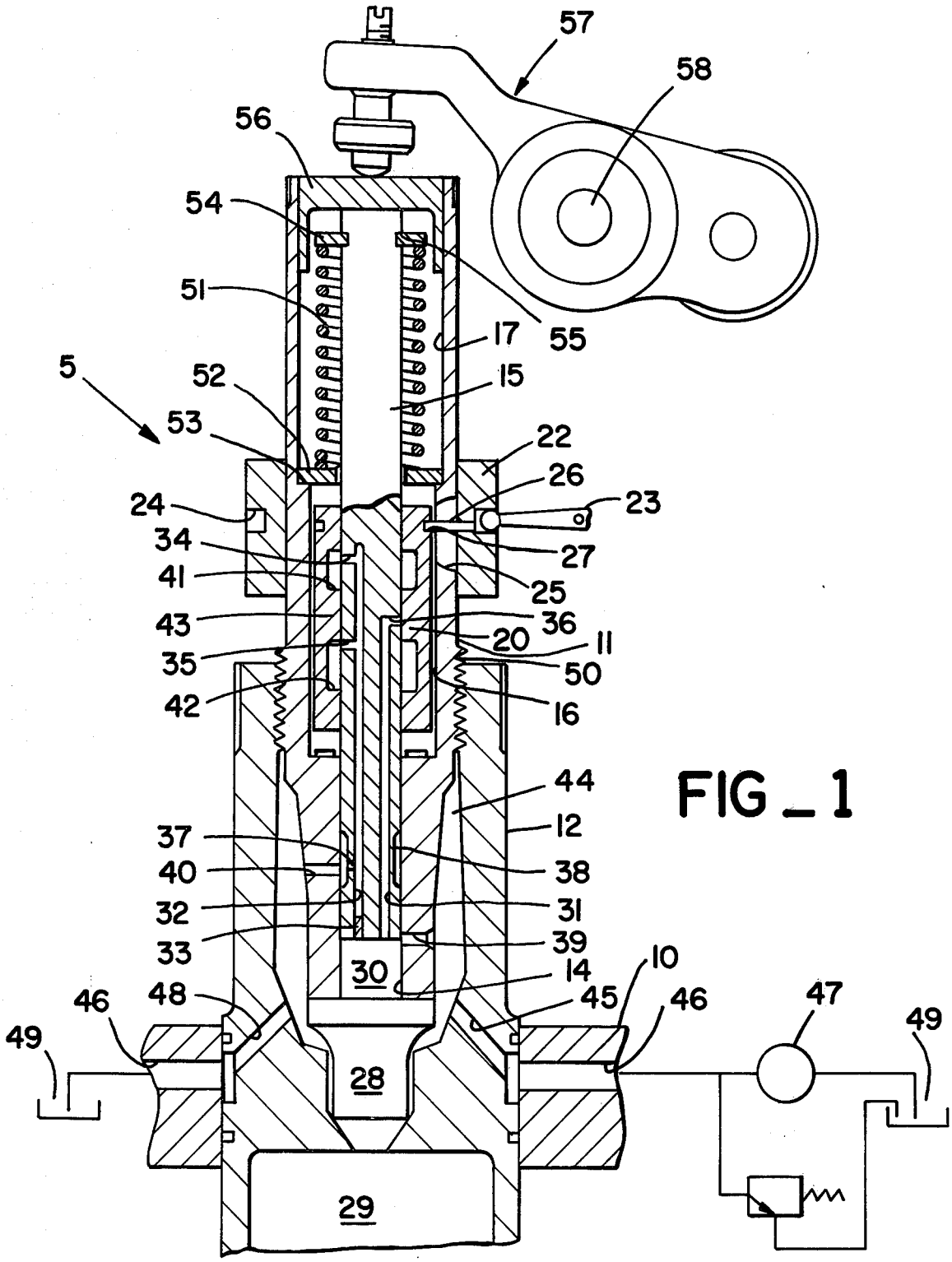
FIG. 1 is an elevation view partly in section and partly schematic of a unit fuel injector in accord with the principles of this invention.

Referring to FIG. 1, a unit fuel injector 5 is shown mounted in a cylinder head 10 of a compression ignition type engine such as a diesel engine or the like. The unit fuel injector 5 includes an elongated body such as housing 11 threadably engageable in an axial bore of mounting portion 12 which sealingly engages the cylinder head 10. Disposed in an axial bore 14 of housing 11 is a cylindrical plunger 15 which is movable reciprocally within the axial bore. Housing 11 is formed with stepped counter-bores 16 and 17 with counter-bore 17 being proximate the end distal of cylinder head 10 and being of the largest interior diameter, and counter-bore 16 communicating counter-bore 17 with axial bore 14. Slidably mounted about cylindrical plunger 15 and interior of counter-bore 16 is a sleeve member 20 which is formed with spaced apart grooves 41 and 42 in the inner surface thereof to define a land 43 supporting the grooves.

Slidably mounted exterior of housing 11 is a collar 22 which is movable reciprocally upwardly and downwardly of housing 11 by means such as lever 23 engaging an annular groove 27 formed in sleeve member 20.

Affixed to housing 11 at the end distal of counterbore 17 is a conventional fuel injection nozzle 28 which is actuable by pressure to inject fuel into a combustion chamber 29 of a compression ignition engine such as a diesel engine. Nozzle 28 forms with housing 11 and cylindrical plunger 15 a cavity 30. Cylindrical plunger 15 is formed with a first axial bore 31 which communicates with cavity 30 and a second axial bore 32 which is plugged proximate cavity 30 by a plug 33. Axial bore 32 intercepts a pair of radial bores 34 and 35 formed proximate sleeve member 20. Axial bore 31 intercepts a third radial bore 36 also proximate sleeve member 20 and intermediate radial bores 34 and 35. A fourth radial bore 37 intercepts axial bore 32 and extends outwardly to an elongated annular groove 38 formed about cylindrical plunger 15 near the end proximate cavity 30.

Housing 11 defines two axially spaced apart radial bores 39 and 40. The first radial bore 39 is located proximate cavity 30, while the second radial bore 40 is located in the vicinity of the elongated annular groove 38.

Housing 11, which, as previously stated, is threadably engaged in mounting portion 12 by conventional threads such as threaded surface 50 mating with a corresponding female threaded surface in mounting portion 12 forms with mounting portion 12 a cavity 44. Fuel may be received in cavity 44 through a passage 45 communicating with a conventional delivery passage 46 in cylinder head 10 which in turn receives fluid from a low pressure pump system 47 in the engine fuel system. Excess fuel is bled off cavity 44 by a passage 48 formed in mounting portion 12 which communicates with the extension of passage 46 in head 10 and in turn leads to sump 49 in communication with the fuel system.

Cylindrical plunger 15 is resiliently biased in the up position as indicated in FIG. 1 by resilient means such as helical spring 51. Helical spring 51 is positioned between a first annular washer 52, which rests on the shoulder 53 formed by counter-bore 16 and counter-bore 17, and a stop member 54 positioned in a groove 55 formed in a cylindrical plunger 15.

Disposed in counter-bore 17 is a cup-shaped actuating member 56 which is movable reciprocally in counter-bore 17 and which abuts cylindrical plunger 15 so that urging of actuating member 56 in the downward direction causes cylindrical plunger 15 to move downwardly compressing helical spring 51.

Although not a portion of this invention, but for a better understanding of the invention, a cam operated lever mechanism 57 is shown engaging actuating member 56. The cam operated lever mechanism may be pivotally mounted at 58 to the engine housing.

Operation of the preferred embodiment should be apparent to those skilled in the art; however, the following description is offered for clarity. Fuel is supplied through passage 46 and passage 45 to cavity 44 from the fuel system which includes pump 47 and fuel supply 49. Fuel in cavity 44 is under a relatively low pressure and may flow through radial bore 39 into cavity 30 with the cylindrical plunger 15 in the full up position. It will become apparent in the ensuing discussion that the pressure in cavity 30 drops below the pressure in cavity 44 as the cylindrical plunger 15 is urged upwardly by resilient member 51 thus creating partial vacuum in cavity 30 relative to cavity 44 after the initial stroke imparted to cylindrical plunger 15 by the cam operated lever 57. With fluid in cavity 30, the timing mechanism of the engine is designed to impart a downward motion to cylindrical plunger 15 at a predetermined time relative to engine shaft rotation to inject fuel into combustion chamber 29 through nozzle 28 at an optimum time. Upon downward movement of cylindrical plunger 15, radial bore 39 is first blocked thus increasing pressure in cavity 30. Pressure increases until it reaches a level sufficient to open nozzle 28 and thus inject fuel into the combustion chamber 29. Nozzle 28 is conventional, and it will not be further described other than to say such nozzles include resilient biasing to maintain them in the closed position until sufficient pressure is generated to open the nozzle. Fuel is injected into combustion chamber as long as radial passage 36 in cylindrical plunger 15 is blocked by land 43. The position of land 43 is determined externally by lever 23 moving pin 26 upwardly and downwardly, thus affecting the timing of the shut-off of fuel injection through nozzle 28. When radial passage 36 comes into register with groove 42 of sleeve 20, pressure is relieved in cavity 30 almost instantaneously and vented through radial passage 35, axial passage 32, radial passage 37, and radial passage 40 into cavity 44. From radial passage 44 fluid may either pass again through radial passage 39 into cavity 30 for the next injection cycle or pass outwardly of the unit fuel injector through passage 48 and 46.

It should be apparent that return of cylindrical plunger 15 will first close radial passage 36 thus initiating the previously mentioned partial vacuum in cavity 30 as the cylindrical plunger is urged upwardly by resilient member 51. As plunger 15 continues to move upwardly, radial passage 39 opens, at which time fluid passes from cavity 44 into cavity 30 through radial passage 39 for the next fuel injection cycle.

DESCRIPTION OF THE ALTERNATE EMBODIMENT

Figure 2:
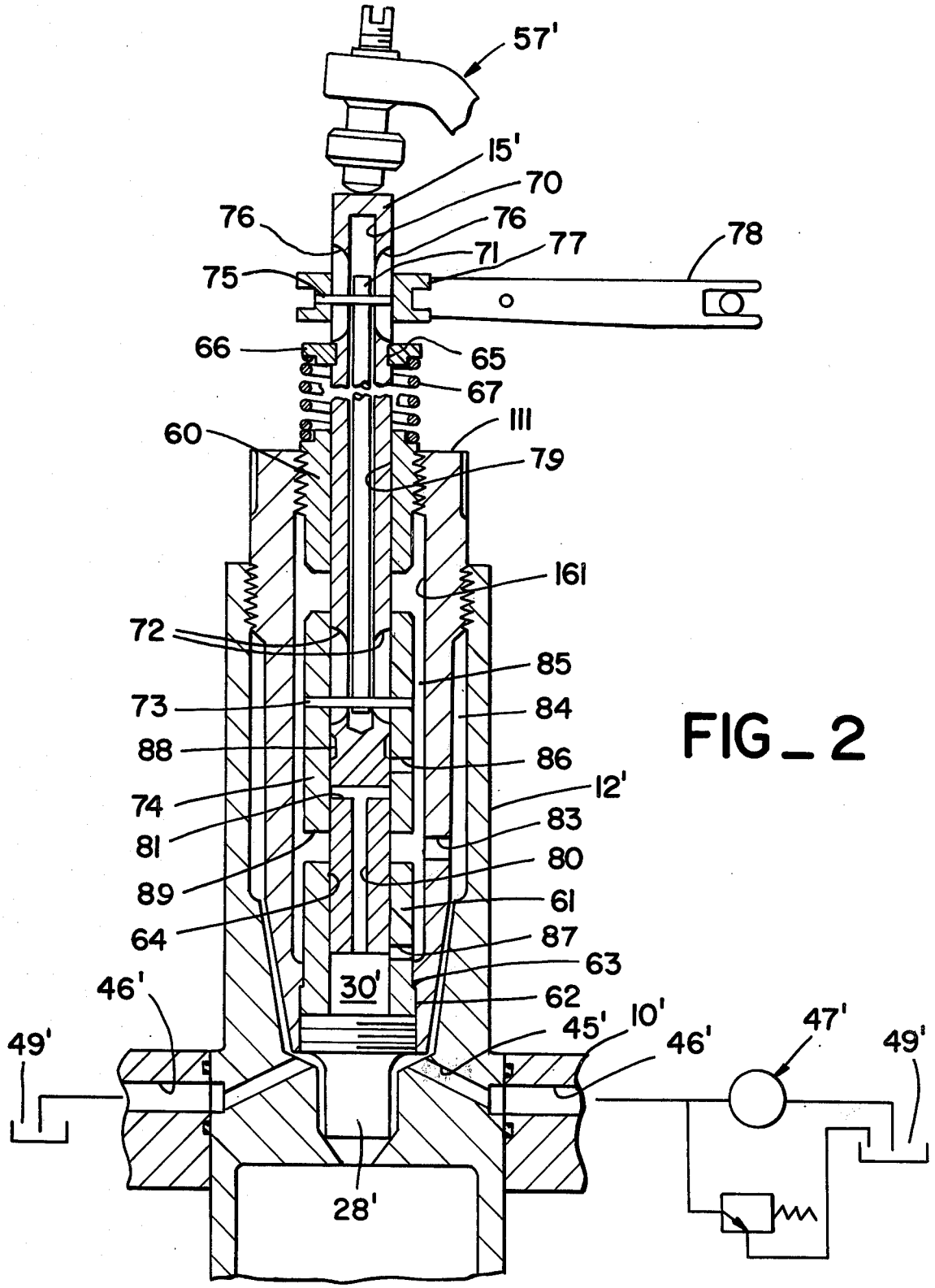
FIG. 2 is an elevation view of a second embodiment of the unit fuel injector shown in FIG. 1.

Referring to FIG. 2, an alternate embodiment of the sleeve type unit fuel injector is illustrated with similar parts carrying like numbers followed by a prime.

Housing 12' is affixed in cylinder head 10' in a manner well known in the art and similar to that of the preferred embodiment. Threadably engaged in housing 12' is a body 111 defining an internal bore 161 which is closed at its first end by a sealing member 60. Body 111 has threadingly fitted in its second end nozzle 28' which engages an elongated body such as housing or barrel member 61 formed with a flange 62 which engages a shoulder 63 formed in internal bore 161. Sealing member 60 and barrel 61 are each formed with axial bores 79 and 64, respectively. Reciprocally mounted in the axial bore 63 and 64 is a plunger 15' which is responsive to a cam operated lever 57' for a movement in bore 63 and 64.

An annular groove 65 is formed about cylindrical plunger 15' so that a stop member 66 may be received therein to act as an abutting surface for a resilient member such as helical spring 67. Helical spring 67 serves to urge cylindrical plunger 15' outwardly of barrel 61 to form a cavity 30' with the nozzle 28'. Cylindrical plunger 15' is formed with an axial bore 70 in which a control rod 71 is disposed. Control rod 71 has extending diametrically outwardly through matched axial grooves 72 of cylindrical plunger 15' a pin member 73 which engages a slidable sleeve 74. At the other opposite end of control rod 71 is a second pin 75 which extends outwardly of axial grooves 76 to engage a collar 77 which is movable upwardly and downwardly by a lever 78. Thus, movement upwardly and downwardly of lever 78 is reflected in movement upwardly and downwardly of sleeve 74.

Cylindrical plunger 15' is formed with a second axial bore 80 at the end proximate cavity 30' which terminates in a radial passage 81 formed crosswise in cylindrical plunger 15'. It is important to note that axial bore 80 and radial passage 81 do not intercept axial bore 70. Body 111 defines a radial bore 83 which communicates the cavity 84 formed between body 111 and mounting member 12' which a cavity 85 formed interior of body member 111 through which the cylindrical plunger 15' reciprocates and in which sleeve member 74 is disposed. Sleeve member 74 defines radial passage 86 communicating cavity 85 inwardly towards cylindrical plunger 15'. A third radial passage 87 is formed in barrel 61. Finally, an annular groove 88 is defined about cylindrical plunger 15' intermediate of cross passage 81 and axial grooves 72. The purpose of these various passages and grooves will become apparent in a discussion of the operation of this embodiment.

Operation of the alternate embodiment is similar to that of the preferred embodiment in that the sleeve member 74 controls the relief of pressure in cavity 30' thus determining the duration of the fuel injection to the associated engine.

In particular, fuel is communicated through passage 46' and 45' to the cavity 84 and then through radial passage 83 into cavity 85. With cylindrical plunger 15' in the full up position (plunger 15' is shown moved down to partially cover passage 87 in FIG. 2), fuel is communicated through radial passage 87 into cavity 30' and upwardly of axial bore 80 and into cross passage 81. Cross passage 81 is blocked except in the full off position by sleeve member 74 thus downward movement of cylindrical plunger 15' will first close radial passage 87 as shown in FIG. 2 so that pressure is increased in cavity 30' to be exhausted through nozzle 28' as in the preferred embodiment. As cylindrical plunger 15' is urged downwardly by lever 57' cross passage 81 is opened as it passes the end 89 of sleeve member 74 to relieve pressure in axial passage 80 and cavity 30'. This relieving of pressure in cavity 30' will terminate the injection of fuel into the associated engine.

Even though sleeve member 74 is relatively close fitting about cylindrical plunger 15', the pressure developed in cavity 30' is sufficient to cause a certain degree of fluid flow outwardly of cross passage 81. In order to prevent excess fluid from passing into axial bore 70, the radial groove 88 is formed to communicate such fluid collected therein out through radial passage 86 to cavity 85.

One other feature of this structure is found in sealing member 60 which is formed to closely fit about cylindrical plunger 15' while a rather loose fit is provided in the threaded juncture of sealing member 60 and body 111. This rather loose fitting juncture enables the cylindrical plunger 15' and sealing member 60 to align with barrel 61. Once plunger 15' is positioned in barrel 61 and sealing member 60 threadably engaged in body 111, an epoxy type sealant may be interposed between the sealing member 60 and the body 111 to lock sealing member 60 in an aligned relationship with barrel 61.

In both embodiments the unit injector is essentially symmetrical so that orientation of the plunger may be random relative the housing and orientation of the housing may be random relative the cylinder head. Not only does this relative symmetry ease the manufacturing process, it simplifies installation.

Although this sleeve type unit fuel injector has been described in relation to two embodiments, it is to be understood that other variations may be made without departing from the scope of the specifications.

The embodiments of the invention in which an exclusive property or privilege is claimed are defined as follows:

1. A unit fuel injector comprising:

a mounting portion defining a bore therethrough and adapted for communication of fuel thereto;

an elongated housing fixedly disposed in said mounting portion bore, said housing defining an axial bore therethrough and first passage means for communicating fuel from said mounting portion to said axial bore;

pressure actuated nozzle means sealingly affixed at one end of said axial bore;

plunger means resiliently biased to a first position in said axial bore to form a first cavity with said nozzle means and said axial bore, said plunger means allowing said first passage means to communicate with said first cavity, said plunger means movable in a first direction for blocking said first passage means and increasing pressure of fluid in said cavity sufficiently to actuate the pressure actuated nozzle means whereby fluid is communicated outwardly of said cavity through said nozzle means, and further said plunger means defining second passage means communicating with said first cavity for selectively venting said first cavity;

sleeve means slidably disposed about said plunger means and axially positionable relative said housing along said plunger means for selectively opening said second passage means to vent said increased pressure in said first cavity through said second passage means at a predetermined position of said plunger means relative to said sleeve means.

2. The unit fuel injector set forth in claim 1 further comprising means for positioning said sleeve.

3. The unit fuel injector set forth in claim 2 wherein the elongated housing defines third passage means axially displaced from said first passage means for communicating fuel from the axial bore.

4. The unit fuel injector of claim 3, wherein the plunger means comprises a cylindrical plunger and wherein said second passage means comprises first and second parallel axial passages defined in said cylindrical plunger, said first axial passage communicating with the first cavity through one end of the cylindrical plunger;

and wherein the sleeve means further comprises a sleeve defining two interior annular grooves separated by a land;

and wherein said second passage means further comprises first and second radial passages defined in said plunger communicating with said second axial passage each displaced axially one from the other at a distance generally equal to said land, said second passage means further comprising a third radial passage defined in said plunger and communicating with said first axial passage at a position generally between the aforedescribed first and second radial passages defined in the cylindrical plunger, said second passage means further comprising a fourth radial passage and an annular groove defined about said plunger, said fourth radial passage communicating said annular groove with said second axial passage, said annular groove of said plunger in communication with the third passage means communicating fuel from the axial bore.

5. The unit fuel injector of claim 2 wherein the plunger means comprises an elongated cylindrical plunger defining an axial passage communicating with the first cavity, and further defines a diametrical passage communicating with said axial passage, and further wherein the sleeve means comprises a sleeve positionable to block said diametrical passage.

6. The unit fuel injector of claim 5 where said sleeve defines a single radial passage and said sleeve is positionable axially along said cylindrical plunger to communicate said single radial passage with the diametrical passage at a predetermined position of said plunger relative said sleeve.

7. The unit fuel injector as set forth in claim 6 further comprising a sealing member defining an axial bore therethrough, said cylindrical plunger reciprocally movable through said sealing member with said sealing member affixed in the mounting portion.

8. The unit fuel injector as set forth in claim 7 further comprising resilient means for urging said cylindrical plunger to the first position.

9. The unit fuel injector as set forth in claim 8 wherein said resilient means comprises a helical spring disposed about said cylindrical plunger and a stop member rigidly associated with said cylindrical plunger exterior of said mounting portion and spaced apart from said sealing member, said helical spring disposed between said sealing member and said stop member.

10. The unit fuel injector as set forth in claim 9 wherein the cylindrical plunger defines a second axial bore, and further wherein the means for positioning the sleeve comprises a control rod reciprocally movable in said second axial bore, pin means rigidly associated with said control rod and said sleeve, and exterior mounted lever means for moving said control rod reciprocally in said second axial bore.

* * * * *